United States Patent [19]

Gold

[11] Patent Number: 5,052,718

[45] Date of Patent: Oct. 1, 1991

[54] RETAIL COUPONING SYSTEM

[76] Inventor: Raymond Gold, 8 Firethorne Cir., Lafayette Hill, Pa. 19444

[21] Appl. No.: 617,364

[22] Filed: Nov. 23, 1990

Related U.S. Application Data

[63] Continuation-in-part of Ser. No. 537,515, Jun. 13, 1990, abandoned.

[51] Int. Cl.[5] ..... B42D 15/00

[52] U.S. Cl. ..... 283/105; 283/51; 283/56; 283/101; 283/106; 283/901

[58] Field of Search ..... 283/51, 56, 72, 100, 283/101, 103, 106, 105, 901

[56] References Cited

U.S. PATENT DOCUMENTS

| | | | |
|---|---|---|---|
| 2,109,603 | 3/1938 | Worth | 283/103 |
| 3,334,806 | 8/1967 | Hiersteiner | 475/232 |
| 3,582,111 | 6/1971 | Siiter | 283/56 |
| 3,734,544 | 5/1973 | Fishkin et al. | 283/56 |
| 3,900,219 | 8/1975 | D'Amato et al. | 283/101 |
| 4,011,985 | 3/1977 | Simson | 229/68 R |
| 4,033,611 | 7/1977 | Johnsen | 283/101 |
| 4,195,864 | 4/1980 | Morton et al. | 283/56 |
| 4,307,900 | 12/1981 | Krautsack | 283/56 |
| 4,685,699 | 8/1987 | Hirasawa | 281/15.1 |
| 4,722,544 | 2/1988 | Pettit | 280/688 |
| 4,738,473 | 4/1988 | Meloni et al. | 283/903 |
| 4,778,153 | 10/1988 | Bachman et al. | 283/101 |
| 4,817,990 | 4/1989 | Krost | 283/101 |
| 4,868,027 | 9/1989 | Hunkeler et al. | 428/42 |

FOREIGN PATENT DOCUMENTS 2414765 8/1979 France .

OTHER PUBLICATIONS

Free Standing Insert, Nov. 1989 "AMORE".
Washington Post, Nov. 7, 1974 "SARA LEE".
Washington Post, Sep. 21, 1972 "IRISH SPRING" (two pages).
"SHOWBOAT'S" promotion (expires Aug. 7, 1987).
Various "McDONALD'" promotions (various expiration dates) (two pages).
"Lipton/Campbell's" option document-Example of U.S. Pat. No. 4,817,900-Krost.

*Primary Examiner*—P. W. Echols
*Assistant Examiner*—David P. Bryant
*Attorney, Agent, or Firm*—Caesar, Rivise, Bernstein, Cohen & Pokotilow, Ltd.

[57] ABSTRACT

A couponing system by which a consumer selects one of two coupons, hidden from the consumer, by pulling one of two zipper pulls which shears, destroys and renders invalid the non-selected coupon, while keeping intact the selected coupon.

33 Claims, 4 Drawing Sheets

RETAIL COUPONING SYSTEM

RELATED APPLICATION

This application is a continuation-in-part of U.S. Application Ser. No. 07/537,515 filed June 13, 1990, now abandoned.

TECHNICAL FIELD

The present invention relates, in general, to retail coupons and, in particular, to multiple value coupons of the so-called "option" or "elf-destruct"type.

BACKGROUND OF THE INVENTION

Consumer packaged goods companies are always looking for effective ways to increase the market share of their brands. The "option" or "self-destruct" retail coupon is one such technique. The consumer is encouraged to purchase more product or convert from a competitor's product. The "option" or "self-destruct" retail coupon is arranged with multiple coupons, one of which is to be selected by the consumer. When the selection is made, the selected coupon remains intact as a coupon and can be redeemed at the store, while the non-selected coupon is destroyed and the non-selected coupon is rendered invalid, thereby negating double redemption. A coupon is rendered invalid when it lacks the legal terms and conditions covering the consumer redemption conditions and retailer reimbursement text.

Various designs for option or self-destruct coupons have been suggested or put into actual use. Generally, they have not been adequately satisfactory in accomplishing their intended purpose. The manner in which the option or self-destruct coupon is to be used might not be clearly understood by the consumers. The arrangement of the coupons can confuse the consumer. The invalidation of the non-selected coupon might be inadequate, so that the "destroyed" coupon retains the appearance of a valid coupon. Besides consumer confusion if the multiple coupon is not understood and the desired coupon is not removed correctly, there can be even more confusion at the check-out counter of the store where the consumer is seeking redemption of the coupon.

SUMMARY OF THE INVENTION

A couponing system, according to the present invention, has first and second sections removably attached to each other along their edges to hide from view text on the inside surface of the first section. The first section has first and second coupons on its inside surface which extend along a length of the first section. The first section also has means for tearing the first section along first and second lines. The first line extends through the first coupon and is displaced from the second coupon and the second line extends through the second coupon and is displaced from the first coupon.

DETAILED DESCRIPTION OF THE INVENTION

Figure 1:
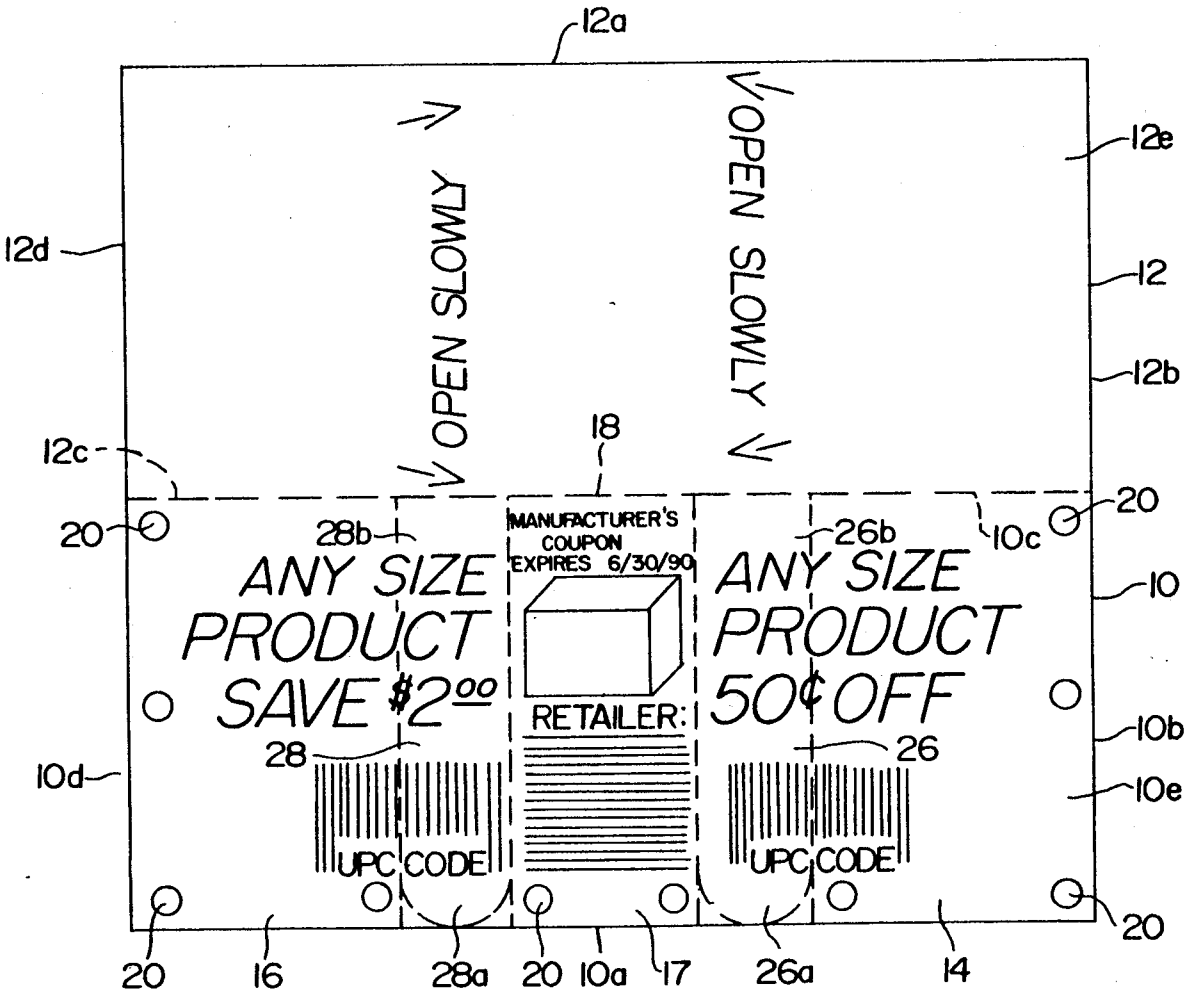
FIG. 1 is a plan view of a first preferred embodiment of a couponing system constructed in accordance with the present invention prior to its formation into a product as it is actually used.
Figure 2:
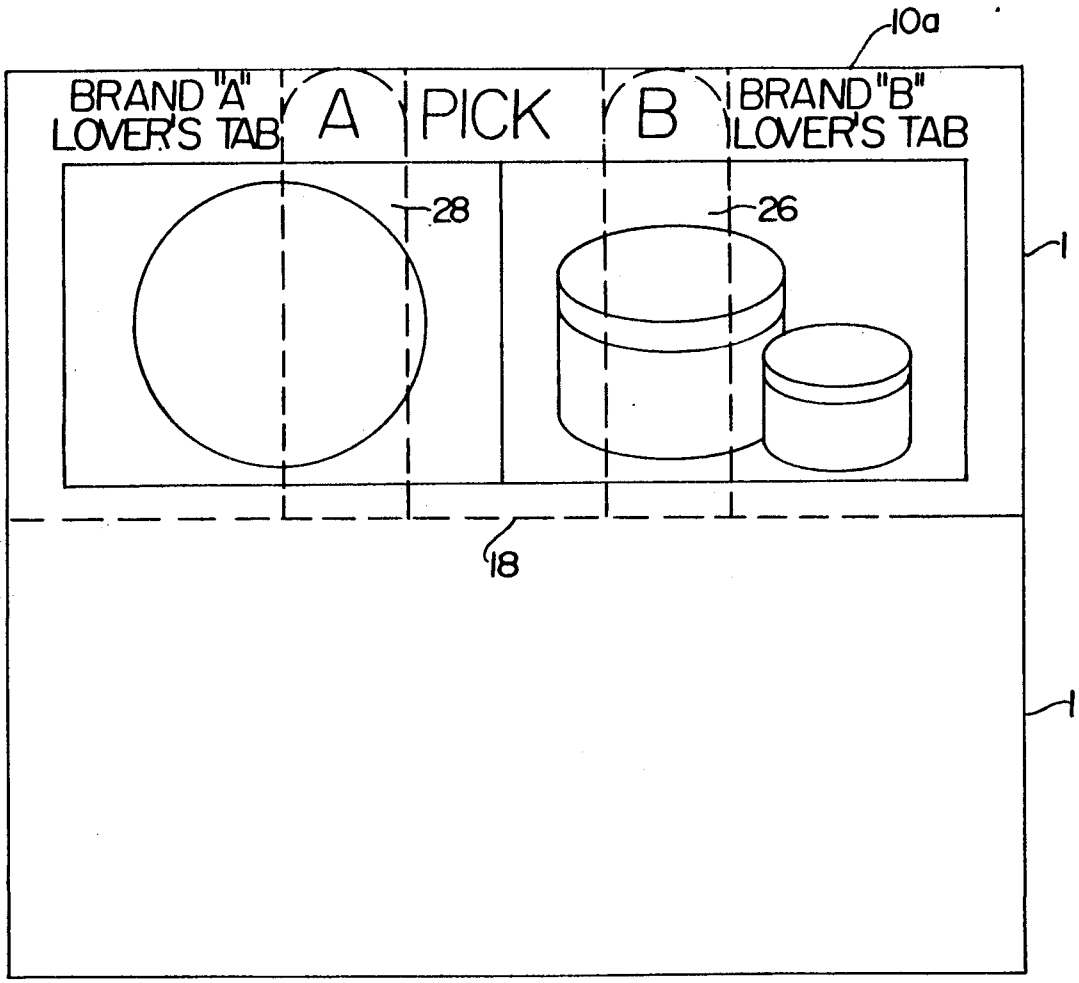
FIG. 2 is a plan view of the opposite side of the FIG. 1 couponing system.

Referring to FIGS. 1 and 2, a couponing system, oonstruoted in accordance with the present invention, includes first and second sections 10 and 12, respectively, attached to each other along their edges 10*a* and 12*a*, 1O*b* and 12*b*, 10*c* and 12*c*, and 1O*d* and 12*d*. The attachment of sections 10 and 12 is such that text on either of the inside surfaces 1O*e* and 12*e* of sections 10 and 12, respectively, which face each other are hidden from view. Section 10 has first and second coupons 14 and 16, respectively, with the text of the coupons on inside surface 10*e* of section 10. Both of the coupons 14 and 16 extend along the same edge of section 10. As illustrated, section 10 is rectilinear, and specifically rectangular, with coupons 14 and 16 extending along edge 10*c* which defines one of the long edges of section 10. With this arrangement, coupons 14 and 16 have a common portion 17 which contains the required redemption text. One edge of common portion 17 extends through coupon 14 and defines one edge of coupon 16, while a second edge of common portion 17 extends through coupon 16 and defines one edge of coupon 14.

Section 12 is removably attached to section 10 to permit separation of portions of section 10 from section 12. For the embodiment of the invention illustrated in FIG. 1, sections 10 and 12 are attached along edges 10*c* and 12*c* by a perforated line 18 and by spots of adhesive 20 at the other long edge and at the short edges of sections 10 and 12 after folding about perforated line. When in form for actual use, the consumer views the text as shown in FIG. 2 but does not view the text as shown in FIG. 1.

A couponing system, constructed in accordance with the present invention, also includes means for tearing section 10 along first and second lines, the first line extending through coupon 14 and displaced from coupon 16 and the second line extending through coupon 16 and displaced from coupon 14. For the embodiment of the invention illustrated in FIGS. 1 and 2, the tearing are in the form of first and second zipper pulls 26 and 28, respectively, on which the value portions of the coupons are located (i.e. "50¢" on zipper pull 26 and "$2.00 " on zipper pull 28). Zipper pulls 26 and 28 are centered on the aforementioned first and second lines, respectively. Zipper pulls 26 and 28 are disposed perpendicular to edge 1O*c* and terminate at edge 10*c*. A zipper pull is a perforated portion of a body of paper which can be separated from the body of paper along the perforations. Each of the zipper pulls 26 and 28 has a zipper pull tab end 26*a* and 28*a*, respectively, at the opposite long edge 1O*c* of section 10 and a zipper run 26*b* and 28*b*, respectively. As a result, zipper pulls 26 and 28 extend between the opposite long edges of section 10. When pulled at their respective pull tab ends at which locations there is no adhesive, the zipper pulls separate from section 10 along their respective runs. As indicated, the inner edges of the zipper pulls define common portion 17 of the coupons.

The couponing system of the present invention is intended to give a consumer the choice of selecting one of the coupons 14 and 16 which are contained on section 10 but which are concealed from the consumer prior to selection by the consumer. Once the selection is made, the selected coupon remains intact and can be presented for redemption, while the non-selected coupon is destroyed and rendered invalid, thereby preventing double-redemption. Thus, the selection process in using the couponing system of the present invention involves simultaneously making possible the removal of the selected coupon, while destroying and rendering invalid the non-selected coupon.

Coupon selection is made by pulling either zipper pull 26 or zipper pull 28. The zipper pulls are so disposed, relative to coupons 14 and 16, that when zipper pull 26 is pulled, coupon 14 is torn and destroyed and rendered invalid as the value portion (i.e. "50¢" ) is taken away from the remainder of the coupon, while coupon 16 remains intact and when zipper pull 28 is pulled, coupon 16 is torn and destroyed and rendered invalid as the value portion (i.e. "2.00") is taken away from the remainder of the coupon, while coupon 14 remains intact. By carrying away the value portion of the non-selected coupon, the chances of improperly redeeming the non-selected coupon are greatly reduced, if not eliminated entirely, because the non-selected coupon is truly invalidated by obviously lacking the redemption value.

When one or the other of the zipper pulls is pulled, text on inside surface 12*e* of section 12 is exposed and revealed to the user, instructing the user how to remove the selected coupon. This is done by gently pulling the selected coupon away from section 12. Text which instructs the user on how to remove the selected coupon need not be presented on the inside surface of section 12 but instead can be presented on the exposed, outside surface of section 10 along with instructions on which zipper pull is associated with each coupon, or can be presented on the inside surface of section 10 which bears the coupons.

For the embodiment of the invention illustrated in FIG. 1, when coupon 14 is selected, the adhesive bond along edges 1O*a* and 12*a* and the adhesive bond along edges 10*b* and 12*b* are broken and perforated line 18 is torn along the length of coupon 14 and when coupon 16 is selected, the adhesive bonds along edges 1O*a* and 12*a* and the adhesive bonds along edges 10*d* and 12*d* are broken and perforated line 18 is torn along the length of coupon 16. The nature of the adhesive selected for the couponing system is such that it serves as a bond in attaching sections 10 and 12 together and withstands the tendency of sections 10 and 12 to separate as one of the zipper pulls is pulled, but the adhesive bond is easily broken as a selected portion of section 10 is gently pulled away from section 12. Any of a variety of fugitive adhesives may be used as the adhesive.

Figure 3:
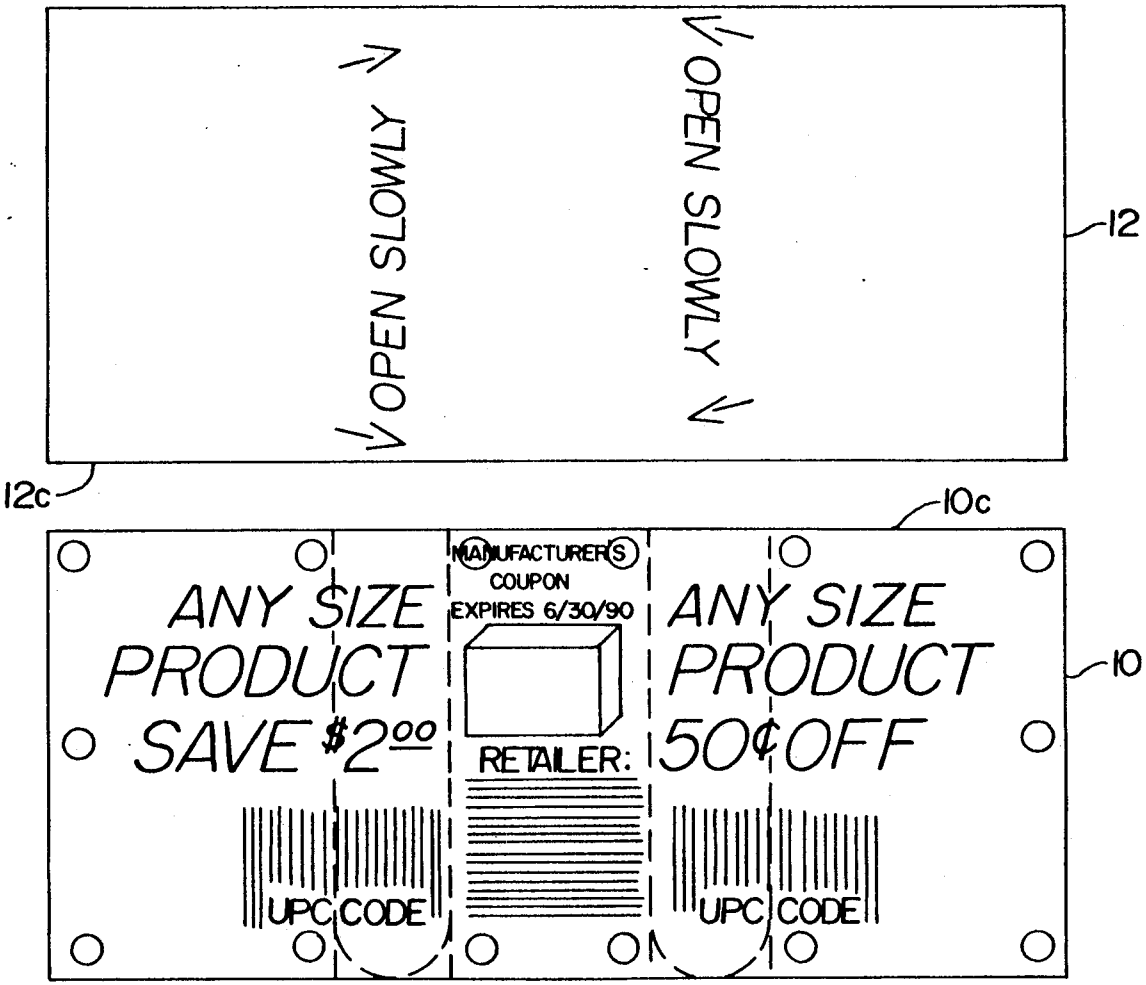
FIG. 3 is a plan view of a second preferred embodiment of a couponing system constructed in accordance with the present invention prior to its formation into a product as it is actually used.

In the embodiment of the invention shown in FIG. 3, sections 10 and 12 are separate pieces which are attached to each other by adhesive at all four common edges, including edges 10*c* and 12*c*, rather than by a perforated line along edges 10*c* and 12*c*. In all other respects, the FIG. 3 embodiment of the invention is identical in construction and operation to the FIG. 1 and 2 embodiment.

Figure 4:
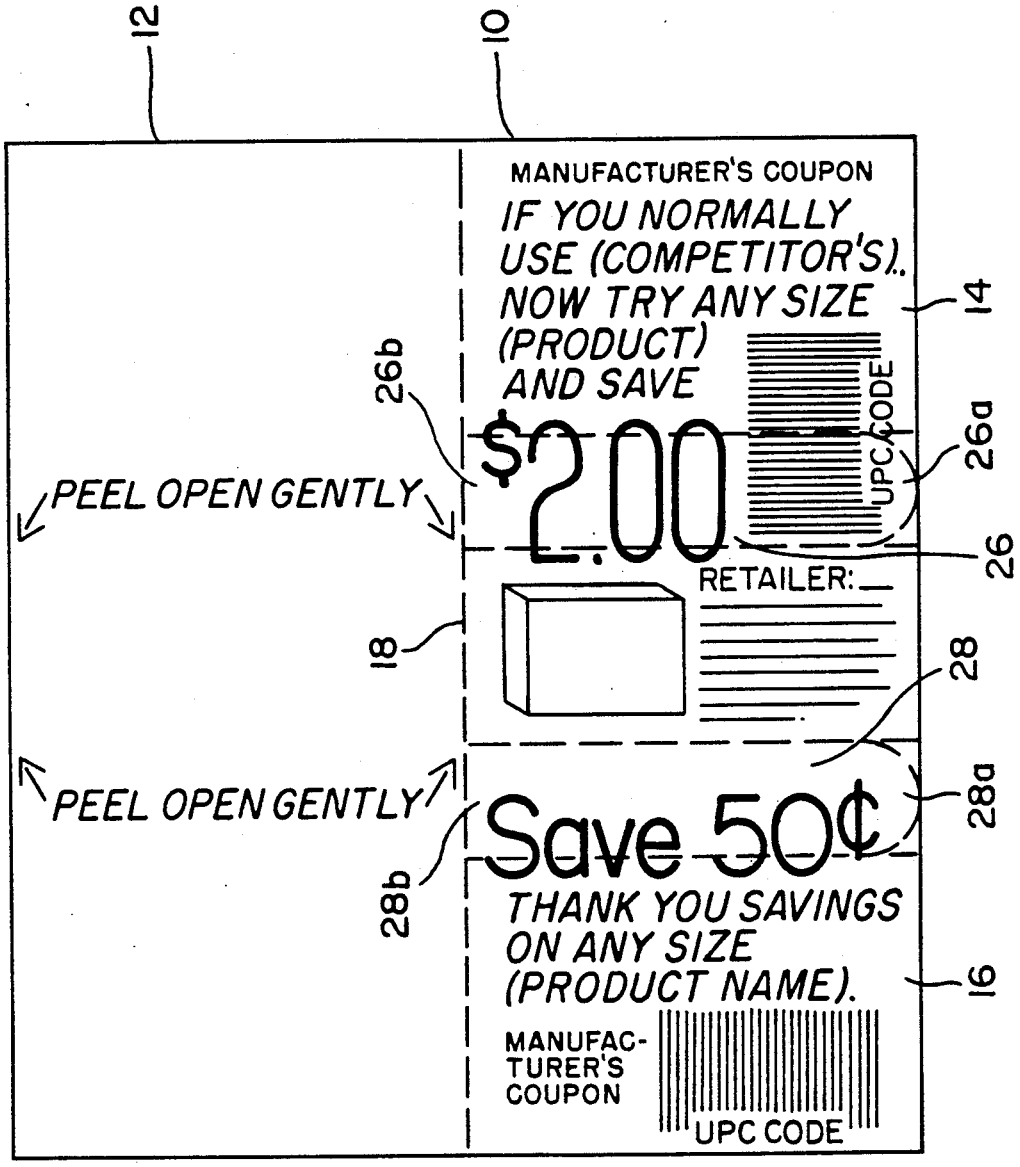
FIG. 4 is a plan view of a third preferred embodiment of a couponing system constructed in accordance with the present invention prior to its formation into a product as it is actually used.

In the embodiment of the invention illustrated in FIG. 4, the value portions of the coupons (i.e. "50¢" and "$2.00" ) extend beyond the bounds of zipper pulls 26 and 28. As a result, the zipper pulls, extending along lines which extend through coupons 14 and 16, carry away only parts of the value portions of the coupons as one coupon is being selected and the other is being torn, destroyed and invalidated. Besides reducing the chances for improper redemption of an invalid coupon, as with the embodiments of the invention illustrated in FIGS. 1, 2 and 3, the FIG. 4 embodiment makes it more difficult for the user to determine the value of the invalid, non-selected coupon which, under certain circumstances, is a highly desirable result.

The embodiments of the present invention illustrated in FIGS. 1, 2, 3 and 4 indicate the applicability of the present invention to an option or self-destruct coupon of the type which hides the values of the coupons from the consumer until coupon selection is made. It should be understood that the present invention also can be applied to an option or self-destruct coupon of the type which reveals the values of the coupons on the outside surface of the couponing system but which hides the text of the coupons themselves from the consumer until coupon selection is made. With such a couponing system, the overall physical arrangement and the layout of the couponing system text, including the hiding of the coupons themselves, reduces, if not eliminates, customer confusion. Instead of having to discern the individual boundaries of overlapping coupons, which is the common arrangement, the consumer needs only to pull one zipper pull or the other consistent with his or her selection and a coupon is selected from the hidden, overlapping coupons.

Although the preferred embodiments of the invention have been illustrated as having rectangular shapes, other configurations, such as a square, can be employed.

While in the foregoing there have been described preferred embodiments of the present invention, it should be obvious to those skilled in the art that various modifications and changes can be made without departing from the true spirit and scope of the invention.

What is claimed is:

1. A couponing system having first and second sections removably attached to each other along their edges to hide from view text on the inside surface of said first section, said first section having (a) first and second coupons extending along a length of said first section with text of said coupons on the inside surface of said first section, and (b) means for tearing said first section along first and second lines, said first line extending through said first coupon and displaced from said second coupon and said second line extending through said second coupon and displaced from said first coupon.

2. A couponing system according to claim 1 wherein said first and said second lines terminate at a first edge of said first section.

3. A couponing system according to claim 2 wherein said first and said second lines extend perpendicular to said first edge of said first section.

4. A couponing system according to claim 3 wherein said first and said second sections are identical rectangles and said first edge of said first section is one of the long edges of said first section.

5. A couponing system according to claim 3 wherein said first and said second coupons have a common portion, a first edge of said common portion extending through said first coupon and defining one edge of said second coupon and a second edge of said common portion extending through said second coupon and defining one edge of said first coupon.

6. A couponing system according to claim 5 wherein said tearing means include a first zipper pull extending along said first line and a second zipper pull extending along said second line.

7. A couponing system according to claim 6 wherein said first and said second sections are identical rectangles and said first edge of said first section is one of the long edges of said first section.

8. A couponing system according to claim 7 wherein said first and said second zipper pulls extend from said first edge of said first section to the opposite long edge of said first section.

9. A couponing system according to claim 8 wherein said first and said second sections are attached to each other by a perforated line at one of said long edges of said first section and by adhesive at the other said long edges of said first section and the short edges of said first section.

10. A couponing system according to claim 8 wherein said first and said second sections are attached to each other by adhesive at the four edges of said first section.

11. A couponing system according to claim 10 wherein said second section contains text on its inside surface facing said inside surface of said first section which is revealed to a user when either of said zipper pulls is pulled to expose said text.

12. A couponing system according to claim 9 wherein said second section contains text on its inside surface facing said inside surface of said first section which is revealed to a user when either of said zipper pulls is pulled to expose said text.

13. A couponing system according to claim 1 wherein each of said coupons has a value portion and said first line extends through the value portion of said first coupon and said second line extends through the value portion of said second coupon.

14. A couponing system according to claim 13 wherein said tearing means include a first zipper pull extending along said first line through said value portion of said first coupon and a second zipper pull extending along said second line through said value portion of said second coupon.

15. A couponing system according to claim 14 wherein said first zipper pull contains the entire value portion of said first coupon and said second zipper pull contains the entire value portion of said second coupon.

16. A couponing system according to claim 14 wherein a part of said value portion of said first coupon extends beyond the bounds of said first zipper pull and a part of said value portion of said second coupon extends beyond the bounds of said second zipper pull.

17. A couponing system according to claim 14 wherein the only indication of the values of said coupons is said value portions of said coupons.

18. A couponing system comprising:

a first section having:

(a) first and second coupons in substantial alignment with each other and extending along a length of said first section, and (b) first and second zipper pulls extending through said first and said second coupons, respectively, and so disposed that when:

(i) said first zipper pull is pulled through said first coupon, said first coupon is torn, destroyed and rendered invalid and said second coupon remains intact, and (ii) said second zipper pull is pulled through said second coupon, said second coupon is torn, destroyed and rendered invalid and said first coupon remains intact;

and a second section overlying said first section to cover the text of said first and said second coupons and removably attached to said first section to permit separation of portions of said first section from said second section after one of said first and said second zipper pulls has been pulled through its associated coupon.

19. A couponing system according to claim 18 wherein said first and said second zipper pulls terminate at a first edge of said first section.

20. A couponing system according to claim 19 wherein said first and said second zipper pulls extend perpendicular to said first edge of said first section.

21. A couponing system according to claim 20 wherein said first and said second sections are identical rectangles and said first edge of said first section is one of the long edges of said first section.

22. A couponing system according to claim 20 wherein said first and said second coupons have a common portion, a first edge of said common portion extending through said first coupon and defining one edge of said second coupon and a second edge of said common portion extending through said second coupon and defining one edge of said first coupon.

23. A couponing system according to claim 22 wherein said first and said second section are identical rectangles and have first edge of said first section is one of the long edges of said first section.

24. A couponing system according to claim 23 wherein said first and said second zipper pulls extend from said first edge of said first section to the opposite long edge of said first section.

25. A couponing system according to claim 24 wherein said first and said second sections are attached to each other by a perforated line at one of said long edges of said first section and by adhesive at the other of said long edges of said first section and the short edges of said first section.

26. A couponing system according to claim 24 wherein said first and said second sections are attached to each other by adhesive at the four edges of said first section.

27. A couponing system according to claim 26 wherein said second section contains text on its inside surface facing said inside surface of said first section which is revealed to a user when either of said zipper pulls is pulled to expose said text.

28. A couponing system according to claim 25 wherein said second section contains text on its inside surface facing said inside surface of said first section which is revealed to a user when either of said zipper pulls is pulled to expose said text.

29. A couponing system according to claim 18 wherein said first coupon has a value portion through which said first zipper pull extends and said second coupon has a value portion through which said second zipper pull extends.

30. A couponing system having first and second coupons on the same surface of a sheet of paper and extending along a length of said sheet of paper with each of said coupons having a value portion, a first zipper pull extending through said value portion of said first coupon and displaced from said second coupon, and a second zipper pull extending through said value portion of said second coupon and displaced from said first coupon.

31. A couponing system according to claim 30 wherein said first zipper pull contains the entire value portion of said first coupon and said second zipper pull contains the entire value portion of said second coupon.

32. A couponing system according to claim 30 wherein a part of said value portion of said first coupon extends beyond the bounds of said first zipper pull and a part of said value portion of said second coupon extends beyond the bounds of said second zipper pull.

33. A coupon system comprising:

first and second coupons on the same surface of a sheet of paper in substantial alignment with each other and extending along a length of said sheet of paper with each of said coupons having a value portion; and first and second zipper pulls extending through said value portions of said first and said second coupons, respectively, said zipper pulls so disposed that when:

(a) said first zipper pull is pulled through said first coupon, said value portion of said first coupon is separated from said first coupon and said first coupon is destroyed and rendered invalid and said second coupon remains intact, and (b) said second zipper pull is pulled through said second coupon, said value portion of said second coupon is separated from said second coupon and said second coupon is destroyed and rendered invalid and said first coupon remains intact.

* * * * *